US010213016B2

(12) United States Patent
Bellar et al.

(10) Patent No.: US 10,213,016 B2
(45) Date of Patent: Feb. 26, 2019

(54) INTERCHANGEABLE MODULAR SHELF SYSTEM

(71) Applicant: Wal-Mart Stores, Inc., Bentonville, AR (US)

(72) Inventors: Jason Bellar, Bella Vista, AR (US); Mark Propes, Bentonville, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/836,439

(22) Filed: Dec. 8, 2017

(65) Prior Publication Data

US 2018/0184803 A1 Jul. 5, 2018

Related U.S. Application Data

(60) Provisional application No. 62/440,632, filed on Dec. 30, 2016.

(51) Int. Cl.
*A47B 57/42* (2006.01)
*A47B 96/02* (2006.01)
(Continued)

(52) U.S. Cl.
CPC ..... *A47B 57/42* (2013.01); *A47B 96/028* (2013.01); *A47B 96/061* (2013.01); *A47F 5/0031* (2013.01); *A47F 5/103* (2013.01)

(58) Field of Classification Search
CPC ..... A47B 57/42; A47B 96/028; A47B 96/061; A47B 47/022; A47F 5/0838; A47F 5/103
See application file for complete search history.

(56) References Cited

U.S. PATENT DOCUMENTS 2,191,701 A * 2/1940 Wood ..... A47B 57/42 248/243
2,653,783 A * 9/1953 Lindsay ..... A47B 57/42 248/243
(Continued)

FOREIGN PATENT DOCUMENTS

CH 288118 A * 1/1953 ..... A47B 57/42
CH 539410 A * 9/1973 ..... A47B 57/42
(Continued)

OTHER PUBLICATIONS

International Search Report and Written Opinion issued in corresponding International Application No. PCT/US17/65414 dated Feb. 20, 2018 (9 pp).
(Continued)

*Primary Examiner* — Stanton L Krycinski
(74) *Attorney, Agent, or Firm* — Venable LLP; Jeffri A. Kaminski

(57) ABSTRACT

An interchangeable modular shelf system, where a modular shelf framework is made of two support arms and two longitudinal members in a hollow rectangular shape. Onto this modular framework distinct types of display components may be attached, such that a single modular framework may contain a basket and a shelf. The modular framework can be attached to a vertical plane of the gondola rack, and can then be used for easily changing the type of display component attached, or for modifying the arrangement of the display components as necessary.

18 Claims, 4 Drawing Sheets

(51) Int. Cl.

| | |
|---|---|
| ***A47B 96/06*** | (2006.01) |
| *A47F 5/00* | (2006.01) |
| *A47F 5/10* | (2006.01) |

(56) References Cited

U.S. PATENT DOCUMENTS

| | | | | | |
|---|---|---|---|---|---|
| 2,772,846 | A * | 12/1956 | Skar | A47B 57/42 | 211/134 |
| 2,940,603 | A * | 6/1960 | Riedmaier | A47B 57/42 | 108/152 |
| 2,960,761 | A * | 11/1960 | Preader | A47B 57/42 | 248/248 |
| 2,999,599 | A * | 9/1961 | Jentzen | A47B 57/42 | 108/2 |
| 3,015,399 | A | 1/1962 | Radek | | |
| 3,085,693 | A | 4/1963 | Shell | | |
| 3,565,381 | A | 2/1971 | Oliver | | |
| 3,765,344 | A * | 10/1973 | Ferdinand | A47B 45/00 | 108/102 |
| 3,965,826 | A * | 6/1976 | Markham | A47B 57/42 | 108/152 |
| 4,136,783 | A | 1/1979 | Karashima | | |
| 4,760,930 | A * | 8/1988 | Fox | A47B 96/027 | 211/153 |
| 4,966,343 | A * | 10/1990 | Bessinger | A47B 57/42 | 108/108 |
| 5,004,201 | A * | 4/1991 | Bessinger | A47B 57/42 | 108/108 |
| 5,297,486 | A * | 3/1994 | Herrmann | A47B 96/028 | 108/108 |
| 5,351,842 | A | 10/1994 | Remmers | | |
| 5,454,638 | A * | 10/1995 | Bird | A47B 57/42 | 108/108 |
| 5,472,103 | A * | 12/1995 | Merl | A47B 47/022 | 211/187 |
| 5,538,213 | A * | 7/1996 | Brown | A47B 57/42 | 108/108 |
| 5,918,432 | A * | 7/1999 | Mahone | A47B 47/00 | 52/220.2 |
| 6,168,032 | B1 * | 1/2001 | Merl | A47B 96/061 | 108/108 |
| 6,227,636 | B1 * | 5/2001 | Lye | A47B 96/025 | 312/351 |
| 6,267,258 | B1 | 7/2001 | Wilkerson et al. | | |
| 6,364,136 | B1 * | 4/2002 | Weshler | A47B 96/025 | 108/102 |
| 6,412,648 | B1 | 7/2002 | Woolnough et al. | | |
| 6,962,116 | B2 * | 11/2005 | Bienick | A47B 57/48 | 108/108 |
| D551,467 | S * | 9/2007 | Kassanoff | D6/705.6 | |
| 7,654,497 | B1 * | 2/2010 | Karan | A47B 45/00 | 248/243 |
| 7,775,379 | B2 | 8/2010 | Hodge | | |
| 8,038,021 | B2 * | 10/2011 | Chen | A47B 46/005 | 211/187 |
| 8,720,704 | B2 * | 5/2014 | Gupta | A47B 57/38 | 211/74 |
| 8,899,704 | B2 * | 12/2014 | Bienick | A47B 96/028 | 211/90.02 |
| 9,119,471 | B2 * | 9/2015 | Gonzalez | A47B 96/1408 | |
| 9,289,064 | B2 * | 3/2016 | LaMontagne | A47B 96/021 | |
| 9,408,478 | B2 * | 8/2016 | Vogler | A47F 1/125 | |
| 9,468,293 | B2 | 10/2016 | Yang | | |
| 9,468,312 | B2 * | 10/2016 | Denby | A47F 5/0043 | |
| 9,883,756 | B2 * | 2/2018 | Kraiss | A47F 5/103 | |
| 2008/0067909 | A1 * | 3/2008 | Hanson | A47B 96/061 | 312/408 |
| 2009/0139943 | A1 | 6/2009 | Fernandez | | |
| 2016/0120305 | A1 | 5/2016 | Kassanoff et al. | | |

FOREIGN PATENT DOCUMENTS

| | | | | |
|---|---|---|---|---|
| DE | 2824605 | A1 * | 12/1979 | A47B 57/408 |
| DE | 4123421 | A1 * | 1/1993 | A47B 57/42 |
| DE | 9420293 | U1 * | 2/1995 | A47B 96/021 |
| DE | 29920570 | U1 * | 2/2000 | A47B 57/42 |
| DE | 102011012016 | A1 * | 8/2012 | A47B 57/34 |
| EP | 3075285 | A1 * | 10/2016 | A47F 5/103 |
| FR | 1278344 | A * | 12/1961 | A47B 57/045 |
| FR | 1439548 | A * | 5/1966 | A47B 47/02 |
| FR | 2924587 | A1 * | 6/2009 | A47F 3/06 |
| FR | 2988279 | A1 * | 9/2013 | A47B 96/028 |
| GB | 1099617 | A * | 1/1968 | A47B 57/045 |
| GB | 1198887 | A * | 7/1970 | A47B 57/42 |
| WO | WO-9529613 | A1 * | 11/1995 | A47B 57/42 |

OTHER PUBLICATIONS

"DecoBros Supreme Stackable Can Rack Organizer Chrome Finish—YouTube", https://www.youtube.com/watch?v=DHWYG5TFFj8, posted Sep. 14, 2016 (2 pp).

"Rev-A-Shelf 20.75-in W x 18.12-in H Metal 2-Tier Cabinet Cookware Organizer", Lowes.com, accessed Nov. 17, 2016 (2 pp).

"Supermarket display wire stacking basket, metal shelves", alibaba.com, accessed Nov. 17, 2016 (7 pp).

"Generic Mesh Desk Organiser Tidy Office Stationery Container", Amazon.co.uk, accessed Nov. 17, 2016 (2 pp).

"Base Cabinet Pull-Out Chrome 2-Tier Wire Basket", Amazon.com, accessed Nov. 17, 2016 (5 pp).

* cited by examiner

INTERCHANGEABLE MODULAR SHELF SYSTEM

BACKGROUND

1. Technical Field

The present disclosure relates to an interchangeable modular shelf system, and more specifically to an interchangeable modular framework for use with shelving meeting gondola shelving standards.

2. Introduction

Retail shelving systems are found in almost every store and supermarket. In most types of shelving, the shelving bays are held together by vertical, back panels which hold the individual shelves. In many cases, the vertical panels are plain, meaning just a flat surface, but perforated vertical panels are available which can allow pegboard hooks for hanging products. The vertical panel often has holes running vertically, with the holes being used to engage with hooks in the shelving, such that individual shelves can be adjusted to fit as desired. When circumstances require a different storage system, such as a basket, or a gravity-fed can storage system, the entire shelf must be removed and replaced with the alternative unit hooking into the vertical panel.

SUMMARY

A modular framework for a gondola rack, the modular shelf comprising: at least two support arms, wherein: each support arm has a first end and a second end opposite each other; and each support arm has at least two fixed hooked tabs disposed at the respective first ends, the first ends being proximate to a vertical plane of the gondola rack when fixed to the vertical plane of the gondola rack; a first longitudinal member connecting the first ends of the at least two support arms; and a second longitudinal member connecting the second ends of the at least two support, wherein: the at least two support arms are substantially parallel to each other; and the first longitudinal member is substantially parallel with the second longitudinal member, to define a central space there between; and the first longitudinal member, the second longitudinal member, and the at least two support arms each include a top support surface configured to engage with a plurality of display components.

A modular shelf system, comprising: two support arms, each support arm comprising: a first end opposite from a second end, the first end and second end separating a longitudinal section, wherein the first end has at least two hooked tabs configured to couple to a vertical plane of a gondola rack; and a support arm support surface; a first longitudinal member connecting the first ends of the two support arms such that the two support arms are substantially parallel to each other, the first longitudinal member having a first support surface; a second longitudinal member connecting the second ends of the two support arms, the second longitudinal member having a second support surface, the first longitudinal member and the second longitudinal member being substantially parallel to each other and substantially perpendicular to the two support arms; support coupling elements attached to the support arm support surfaces, the first support surface, and the second support surface; a display component having a display portion to display items and display coupling elements configured to engage with a portion of the support coupling elements, wherein when engaged the display coupling elements removeably attach the display component to at least one of the support arm support surfaces, the first support surface, and the second support surface.

A gondola rack comprising: a vertical plane; and a modular shelf comprising: at least two support arms, wherein: each support arm has a first end and a second end opposite each other; and each support arm has at least two fixed hooked tabs disposed at the respective first ends, the first ends being proximate to the vertical plane of the gondola rack when fixed to the vertical plane of the gondola rack; a first longitudinal member connecting the first ends of the at least two support arms; and a second longitudinal member connecting the second ends of the at least two support, wherein: the at least two support arms are substantially parallel to each other; and the first longitudinal member is substantially parallel with the second longitudinal member, to define a central space there between; and the first longitudinal member, the second longitudinal member, and the at least two support arms each include a top support surface configured to engage with a plurality of display components.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

DETAILED DESCRIPTION

Figure 1:
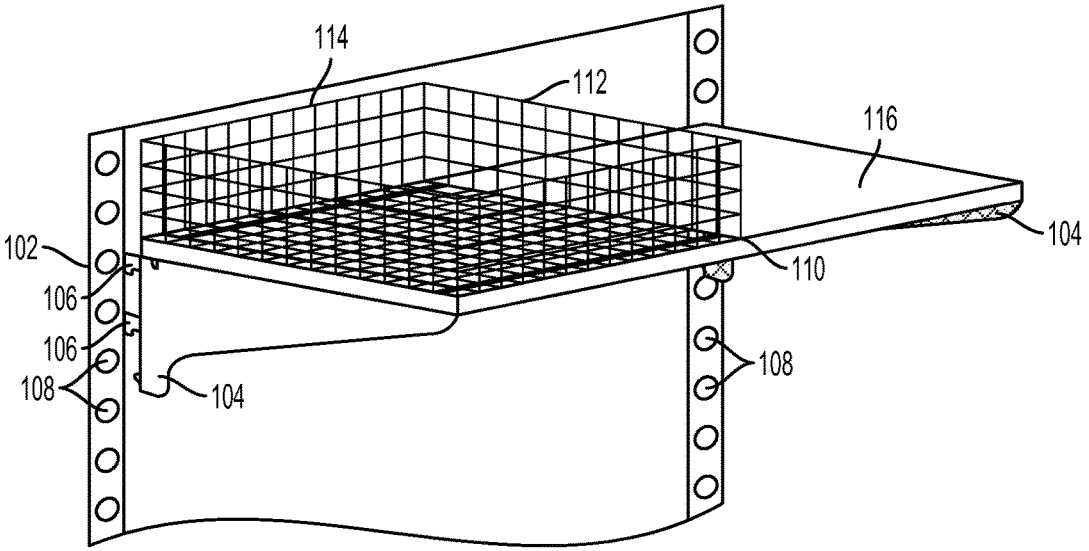
FIG. 1 illustrates an example view of an interchangeable modular framework with a basket component and a shelf component.

Current shelving, and particularly gondola standards shelving, does not allow for customized shelving components being mixed within a single vertical support plane. Once installed, the installed shelving components are static, meaning they cannot be changed without removing the entire component from the hooks which attach to the vertical plane.

By contrast, shelving configured according to this disclosure is interchangeable and modular. The shelving is modular because the display components can be combined with other display components resulting in different combinations of display components within the space normally devoted to a single shelf (i.e., the space between the hanging holes of the vertical plane). The shelving is interchangeable because the display components can be removed and replaced within the modular shelving framework described herein, without the entire shelf being removed. Consider the following example.

A "hollow" rectangular or square shelf can be built having two support arms, or brackets, and two longitudinal members which connect the support arms. Whereas a normal shelf would have a shelf component which covers the space between the support arms, modular shelves configured per this disclosure may have an opening in the middle of the rectangular area surrounded by the support arms and the longitudinal members. Within this opening, multiple distinct display components can be placed. For example, in one configuration, half of the opening can contain a basket while the other half contains a standard shelf. The basket and the shelf can both individually engage with the respective support arms next to the respective components, such that each individual component is removeably secured to the rectangular frame. The support arms contain hooks which engage with the vertical plane, thereby holding the modular shelf and any attached display components in place. The support arms and the longitudinal members can have support surfaces on which the respective display components can rest. These support surfaces can have holes, hooks, or other mechanisms for securing the display components to the framework.

The previous example has a interchangeable, modular shelf with two display components—a basket and a shelf. In other configurations, there can be more or less individual display components. For example, using the interchangeable, modular shelf framework described, a single (vertical-panel wide) basket can be added to the framework, then swapped out for a single (vertical-panel wide) gravity-fed can distribution system. In yet another example, the framework can be divided into thirds, quarters, or other sections, each section receiving its own respective display component. In some configurations, each section can be distinct, for example a shelf, a basket, and a pin storage system can all be attached to the framework. In other configurations, there can be multiple display components of a single type, such as a "shelf-shelf-basket" configuration, or a "basket-shelf-basket" configuration.

The interchangeable, modular shelf framework, as well as any components which can attach to the framework, can be made of any material required for the specific uses and needs of the shelf. For example, while steel may be the most common material used to make the interchangeable, modular shelf, other materials which can be used include cold-rolled steel, stainless steel, aluminum, and any combination of such materials.

Engaging the display components to the support surfaces of the support arms and the longitudinal members can be accomplished by using a pressure system, such as clamps which slide over a rod and use pressure to hold the clamp to the rod, or an angled "Christmas tree" connector which fits into openings in the support surface. Alternatively, engaging the display components to the support surfaces can occur using a turning mechanism, such that a locking element having a turning mechanism is put in place and, to secure the display component, the turning mechanism is turned until movement of the display element is limited. The engagement elements should be able to be released and the display component removed, yet still secure the display component to the modular framework while engaged, such that the display component is considered to be removeably secure.

Preferably, the depth of the interchangeable, modular shelf disclosed herein is approximately 16 inches (40.64 cm). However, in other configurations, interchangeable, modular shelves of distinct dimensions are contemplated. For example, in some configurations a smaller version may be desired, such that the interchangeable, modular shelf has a depth of 8 inches (20.32 cm), whereas another configuration may require a depth of 20 inches (50.8 cm). The length of the interchangeable, modular shelf can vary to meet any gondola vertical plane needed.

Having described the overall concepts of embodiment of the invention, the disclosure now turns to specific examples of variations and configurations as illustrated in FIGS. 1-4. The disclosure now turns to FIG. 1.

FIG. 1 illustrates an example view of an interchangeable modular framework 104, 110, 112 with a basket component 114 and a shelf component 116. The interchangeable modular framework in this example is made of two support arms 104, with a first longitudinal member 112 and a second longitudinal member 110. In some embodiments the support arms 104 have hooks, pegs, or other engagement mechanisms 106 which can be used to connect with holes 108 of a vertical plane 102 as part of a gondola shelving system. The first longitudinal member 112 is located on the "back" portion of the support arms, nearest to the vertical plane 102. The second longitudinal member 110 is located on the "front", or aisle facing, portion of the support arms. In another embodiment, the framework may include a rectangular or square frame which is secured to the support arms, which are connected to the vertical plane.

The support arms 104, the first longitudinal member 112, and the second longitudinal member 112 together form a rectangle (or a square, or other parallelogram), as the support arms are substantially in parallel with one another, the first and second longitudinal members are substantially in parallel with one another, and the support arms are substantially perpendicular to the longitudinal members. "Substantially" can be interpreted to be within 15° of the desired angle, and preferably within 5°. The rectangle of the support arms 104, the first longitudinal member 112, and the second longitudinal member 110 is an interchangeable modular framework which can accommodate multiple display components within the longitudinal space between the holes 108 of the vertical plane 102.

In this example, the framework has a basket 114 and a shelf 116, such that the combined basket 114 and shelf 116 cover the framework formed by the support arms 104 and the longitudinal members. In some configurations, the interchangeable modular framework may be configured to leave gaps within the framework, such as when there is space for three display components but only two are utilized. In other configurations, there may be more than two display components.

Figure 2:
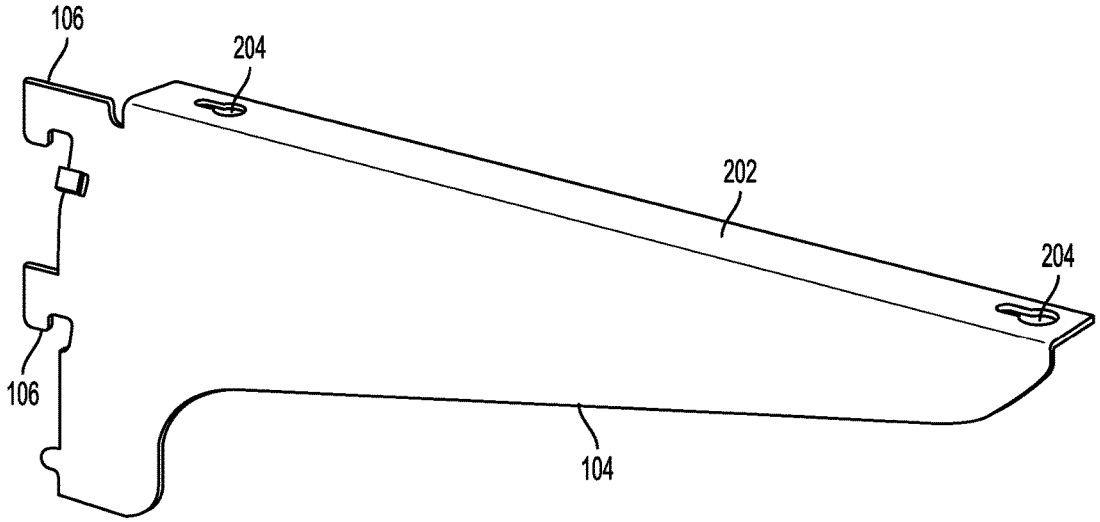
FIG. 2 illustrates an exemplary support arm.

FIG. 2 illustrates an exemplary support arm 104, with hooks 106 for engaging the vertical panel 102 holes 108 of FIG. 1. The support arm 104 has a support surface 202 capable of supporting a display component and securing the display component in place. In this illustration, the support arm 104 support surface 202 has holes 204 to be used for engaging with display components and securing those display components to the support surface 202. In other configurations, the holes 204 may have a distinct shape, or the support arm 104 may have more or less holes 204. In addition, instead of holes 104 the support arm may have clips, or a rod, or another mechanism that engages with a corresponding element on the display component, holding the display component in place.

Figure 3:
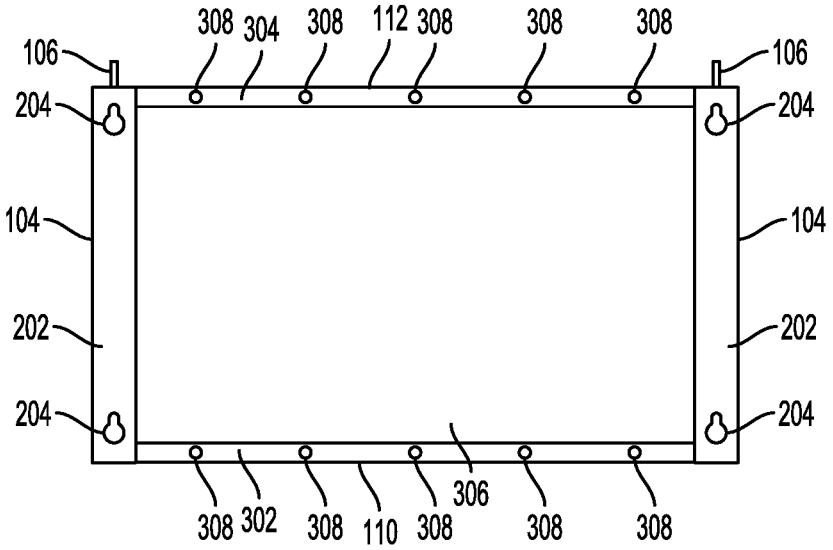
FIG. 3 illustrates an overhead view of an interchangeable modular framework.

FIG. 3 illustrates an overhead view of an interchangeable modular framework. As described above, the framework is formed by two support arms 104, a first longitudinal member 112 and a second longitudinal member 110, where the longitudinal members 110, 112 are substantially parallel to one another, the support arms 104 are substantially parallel to one another, and the longitudinal members 110, 112 are substantially perpendicular to the support arms 104. The support arms 104 and the longitudinal members 110, 112 together form a parallelogram, such as a rectangle or square, having an empty space 306 in the middle. The framework may also be configured to connect to the existing support arms for the shelving system. In the case, it is not necessary for the hooks, etc. for connection to the vertical plane to be provided on the framework.

In this example, the support arms 104 have support surfaces 202 on which display components may rest, and the longitudinal members 110, 112 have support surfaces 302 on which display components may rest. In addition, the support arms 104 have holes 204 which can be used to secure the display components, and the longitudinal members 110, 112 have similar holes 308. The holes 204, 308 may, for example, be used to receive "Christmas tree" connectors which are conical in shape and connected to the display components, the diameter of the conical Christmas tree connector increasing closer to the display component.

Figure 4:
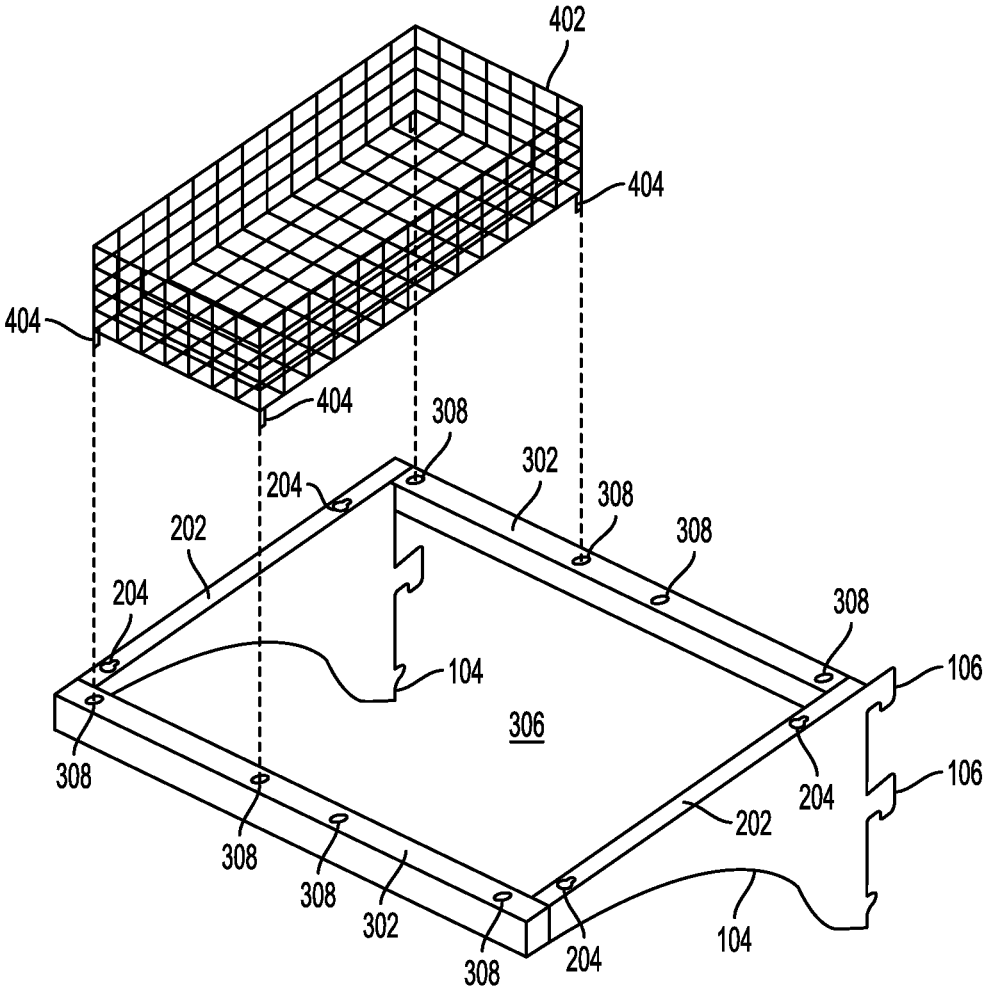
FIG. 4 illustrates an example view of an interchangeable modular framework and an engaging basket.

FIG. 4 illustrates an example view of an interchangeable modular framework and a display component, here basket 402. The framework is formed as described above, such as in FIG. 1 or FIG. 3, however in this example there are four unequally spaced holes 308 in the longitudinal members, with two holes in the center of the respective members which are closer to each other than with the others. The basket 402 will only fill half of the framework, with the pegs 404 of the basket 402 fitting into the holes 308 on one side of the framework. Another basket, or a shelf display component, a gravity fed can dispenser system, a divider, a peg board holder, or any other type of display component, could be placed on the other side of the framework.

In this example, the basket 402 does not engage with the holes 204 in the left support arm 204. However, in other configurations the basket 402 can have additional pegs 404 engage with the side arm holes 204. In addition, while the basket 402 is illustrated as being secured to the top of the framework using the holes 308 in the longitudinal members, there can be configurations where a basket or other storage/display component attaches beneath the interchangeable, modular shelf framework.

The various embodiments described above are provided by way of illustration only and should not be construed to limit the scope of the disclosure. Various modifications and changes may be made to the principles described herein without following the example embodiments and applications illustrated and described herein, and without departing from the spirit and scope of the disclosure.

We claim:

1. A modular framework for a gondola rack, the modular framework comprising:

at least two support arms, wherein:

each support arm has a first end and a second end opposite each other; and each support arm has at least two fixed hooked tabs disposed at the respective first ends, the first ends being proximate to a vertical plane of the gondola rack when fixed to the vertical plane of the gondola rack;

a first longitudinal member connecting the first ends of the at least two support arms; and a second longitudinal member connecting the second ends of the at least two support arms, wherein:

the at least two support arms are substantially parallel to each other; and the first longitudinal member is substantially parallel with the second longitudinal member to define a central space there between; and the first longitudinal member, the second longitudinal member, and the at least two support arms each include a top support surface configured to engage with a plurality of display components; and a first display component of a first type in the plurality of display components engaged with the top support surface over a first portion of the central space and a second display component of a second type in the plurality of display components engaged with the top support surface over a second portion of the central space, the first type being distinct from the second type.

2. The modular framework of claim 1, wherein the first type is a shelf and the second type is a basket.

3. The modular framework of claim 1, wherein the plurality of display components comprises at least two of a basket, a shelf, a divider, and a gravity fed can storage system.

4. The modular framework of claim 1, wherein the first longitudinal member, the second longitudinal member, and the at least two support arms are made using at least one of steel, cold-rolled steel, aluminum, and stainless steel.

5. The modular framework of claim 1, wherein display components in the plurality of display components engage with the support surface by at least one of snapping a component in place using pressure and locking the component in place using a turning mechanism, such that the component is removeably secure.

6. The modular framework of claim 1, wherein the modular framework has a depth of approximately 16 inches (40.64 cm).

7. A modular shelf system, comprising:

two support arms, each support arm comprising:

a first end opposite from a second end, the first end and second end separating a longitudinal section, wherein the first end has at least two hooked tabs configured to couple to a vertical plane of a gondola rack; and a support arm support surface;

a first longitudinal member connecting the first ends of the two support arms such that the two support arms are substantially parallel to each other, the first longitudinal member having a first support surface;

a second longitudinal member connecting the second ends of the two support arms, the second longitudinal member having a second support surface, the first longitudinal member and the second longitudinal member being substantially parallel to each other and substantially perpendicular to the two support arms;

support coupling elements attached to the support arm support surfaces, the first support surface, and the second support surface;

a display component having a display portion to display items and display coupling elements configured to engage with a portion of the support coupling elements, wherein when engaged the display coupling elements removeably attach the display component to at least one of the support arm support surfaces, the first support surface, and the second support surface.

8. The modular shelf system of claim 7, further comprising a second display component having a second display portion to display items and second display coupling elements configured to engage with a second portion of the support coupling elements, wherein when engaged the second display coupling elements removeably attach the second display component to at least one of the support arm support surfaces, the first support surface, and the second support surface.

9. The modular shelf system of claim 8, wherein the display component and the second display component are configured to hold items in distinct manners.

10. The modular shelf system of claim 9, wherein the display component is configured to be a shelf and the second display component is configured to be a basket.

11. The modular shelf system of claim 7, wherein the display coupling elements engage with the support coupling elements by at least one of snapping a component in place using pressure and locking the component in place using a turning mechanism.

12. The modular shelf system of claim 7, wherein the display component is one of a basket, a divider, a shelf, and a gravity fed can storage system.

13. The modular shelf system of claim 7, wherein the first longitudinal member, the second longitudinal member, and the two support arms are made using at least one of steel, cold-rolled steel, aluminum, and stainless steel.

14. A gondola rack comprising:

a vertical plane; and a modular framework comprising:

at least two support arms, wherein:

each support arm has a first end and a second end opposite each other; and each support arm has at least two fixed hooked tabs disposed at the respective first ends, the first ends being proximate to the vertical plane of the gondola rack when fixed to the vertical plane of the gondola rack;

a first longitudinal member connecting the first ends of the at least two support arms; and a second longitudinal member connecting the second ends of the at least two support arms, wherein:

the at least two support arms are substantially parallel to each other; and the first longitudinal member is substantially parallel with the second longitudinal member to define a central space there between; and the first longitudinal member, the second longitudinal member, and the at least two support arms each include a top support surface configured to engage with a plurality of display components; and a first display component of a first type in the plurality of display components engaged with the top support surface over a first portion of the central space and a second display component of a second type in the plurality of display components engaged with the top support surface over a second portion of the central space, the first type being distinct from the second type.

15. The gondola rack of claim 14, wherein the first type is a shelf and the second type is a basket.

16. The gondola rack of claim 14, wherein the plurality of display components comprise at least two of a basket, a shelf, a divider, and a gravity fed can storage system.

17. The gondola rack of claim 14, wherein the first longitudinal member, the second longitudinal member, and the at least two support arms are made using at least one of steel, cold-rolled steel, aluminum, and stainless steel.

18. The gondola rack of claim 14, wherein display components in the plurality of display components engage with the support surface by at least one of snapping a component in place using pressure and locking the component in place using a turning mechanism, such that the component is removeably secure.

* * * * *